US005439221A

United States Patent [19]

Harvie

[11] Patent Number: 5,439,221

[45] Date of Patent: Aug. 8, 1995

[54] PUZZLE GAME

[76] Inventor: Ian Harvie, 29 Roman Road, Stockbridge, Hampshire, S020 6HA, United Kingdom

[21] Appl. No.: 314,513

[22] Filed: Sep. 28, 1994

[30] Foreign Application Priority Data

Sep. 28, 1993 [GB] United Kingdom ..... 9319964

[51] Int. Cl.[6] ..... A63F 9/10

[52] U.S. Cl. ..... 273/157 R

[58] Field of Search ..... 273/157 R, 157 A, 153 R, 273/156; 446/124, 125

[56] References Cited

U.S. PATENT DOCUMENTS 4,756,533 7/1988 Hopkins .
5,067,714 11/1991 Rasberry .

FOREIGN PATENT DOCUMENTS 2182253A 11/1985 United Kingdom .
WO80/01990 3/1990 WIPO .

*Primary Examiner*—Vincent Millin
*Assistant Examiner*—Steven B. Wong
*Attorney, Agent, or Firm*—Larson and Taylor

[57] ABSTRACT

A puzzle game such as a jigsaw has a number of interfitting pieces which combine to create a finished visual effect. A number of the pieces, e.g. in an area of a single color or pattern, can be positioned interchangeably as regards the visual effect. At least some of these interchangeable pieces carry markers enabling their disposition to be determined. For example, the markers may be metal spots whose layout can be determined by scanning using radiation. A particular use of such a puzzle game is in a competition or lottery based on chance, where a number of completed puzzles are submitted for comparison with a standard "solution" layout involving a specific arrangement of the interchangeable pieces.

15 Claims, 2 Drawing Sheets

PUZZLE GAME

FIELD OF THE INVENTION

This invention relates to puzzle games.

BACKGROUND OF THE INVENTION

Puzzles having a number of pieces, which have to be fitted together, are well known. In particular most people are familiar with "jigsaw" puzzles, in which a large number of interlocking pieces can be fitted together to make a recognisable two-dimensional picture or pattern. Jigsaw puzzle pieces are usually of a number of different shapes, and this together with the colour variation over a picture generally means that there is only one "correct" way to complete the puzzle, i.e. correct as to both picture and fitting of pieces. However certain special jigsaw puzzles are known in which, apart from those at the edges, the pieces are all the same shape so that only assessment of the picture/pattern can be used in deciding where each piece is to fit.

SUMMARY OF THE INVENTION

With this invention I aim to provide a new type of game of interfitting pieces, preferably of the nature of a jigsaw puzzle.

I have conceived the idea of making a game which is fitted together by the purchaser and can also be used as a means for entering a draw, lottery or the like.

With this end in view, the invention provides a game which has a plurality of pieces which can be fitted together—preferably with interlock—to form a finished visual picture or pattern. This may be a characteristic shape, especially in the event that the construction is three-dimensional. The shapes of the pieces and the visual picture/pattern elements they carry, are however selected so that at least certain of the pieces can be fitted into the assembly in a number of different positions (orientation and/or location) and still provide such a finished visual effect. This can be simply arranged e.g. by providing those pieces with interfitting parts of the same shape, and similar display (picture/pattern) elements. Alternatively or additionally, such pieces might be fittable with different orientations into any given location in the assembly.

A finished appearance will arise from a coherent combination of the displayed portion of the pieces, recognisable by a person using the puzzle. For example, it might be a recognisable picture or coherent shape.

Specifically, I propose puzzle game apparatus comprising a plurality of pieces, the pieces having display portions and means for interfitting with adjacent said pieces to form an assembled puzzle structure, said assembled puzzle structure having a finished visual scheme and said finished visual scheme being a coherent combination of the display portions of the pieces;

at least a plurality of the pieces being changeable pieces, said changeable pieces being capable of taking more than one possible position in a said assembled puzzle structure whereby the apparatus has a plurality of assembled conditions corresponding to said different possible positions of the changeable pieces and giving an assembled puzzle structure having a said finished visual scheme, and at least a plurality of the changeable pieces comprise respective distinctive markers in addition to their display portions, to indicate distinctively the position of the respective changeable pieces in the assembled puzzle structure and thereby distinguish the assembled conditions from one another in terms of the positions of the markers therein.

In addition to their visual display e.g. picture/pattern elements, at least some of these "interchangeable" pieces carry the distinguishing markers so that various arrangements of the pieces which may be identical as to the visual effect, e.g. picture/pattern, are nevertheless distinguishable with reference to these markers. The markers may take any of a number of forms e.g. codes, shapes, numbers, letters, projections etc. However it is preferred that they are not visible, or at least visually insignificant by comparison with the display portions elements of the pieces concerned, at least in the assembled puzzle structure. This could be achieved e.g. by concealing them inside the pieces, or on any reverse thereof vis a vis the display portion. Furthermore it is particularly preferred that the markers be automatically machine-scannable as to their location and/or orientation in the assembly, most preferably so that their arrangement can be compared with some standard arrangement or solution.

In this way, a large number of such puzzles can be distributed, with the offer to complete the puzzle and submit it as an entry in a competition, lottery or the like. Persons taking part generally complete the puzzle so as to form similar visual effects e.g. pictures, patterns or shapes, but with a great variety of different arrangements of the markers. The submitted completed puzzles are then compared as to the arrangement of markers, preferably by machine, with a standard arrangement or "solution" unknown to those taking part. The number of possible combinations of the markers corresponding to the same visual effect can easily be made sufficiently large that the probability of achieving the "correct" arrangement might only be one in e.g. many thousands or even millions.

The preferred type of puzzle envisaged is a jigsaw-type puzzle, i.e. forming an essentially two-dimensional picture/pattern using interlocking pieces.

The preferred final visual effect is a picture or pattern which has at least one substantial portion, (i.e. made up of a substantial number of pieces), of the same tonal appearance or visual effect e.g. all of one colour. The substantial number of pieces would generally be 10 or more, more preferably 20 or more or even 50 or more. Desirably a major proportion, and preferably all, of the pieces in such a part of the puzzle would comprise markers as described above.

The markers used are preferably susceptible to scanning using some form of radiation. For example, the marking may be achieved by forming one or more portions of a piece with greater or lesser opacity or reflectivity to some selected radiation than other portions. The markers might be shaped thin opaque or reflective (e.g. metal) parts in a piece otherwise composed of card or board.

BRIEF DESCRIPTION OF THE DRAWINGS

Embodiments of the invention are now described by way of example, with reference to the drawings in which.

DETAILED DESCRIPTION OF PREFERRED EMBODIMENTS

Figure 1:
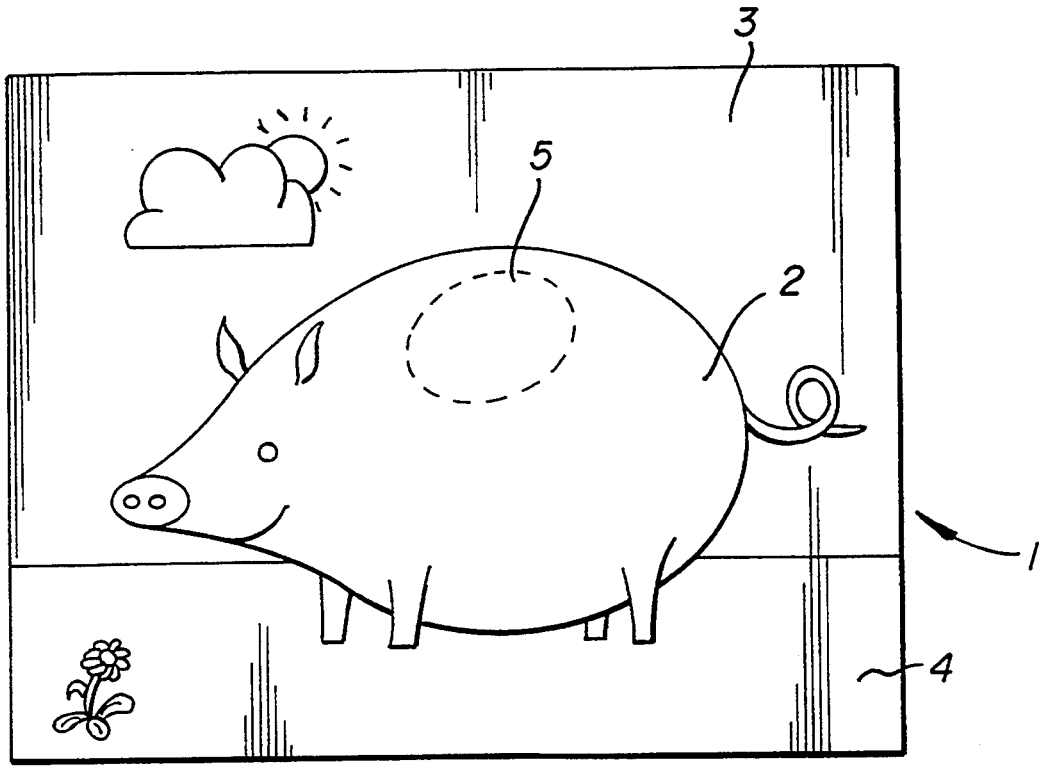
FIG. 1 is a view of an assembled jigsaw puzzle.

FIG. 1 shows a completed jigsaw puzzle 1 which consists in the usual way of a picture design printed on a sheet of paper superimposed on a backing of stiff cardboard, the whole being sub-divided into interlocking pieces.

One feature of the design chosen is that it has large areas of the same colour. In the embodiment shown, the central pig 2 may be uniformly pink, and if desired the sky 3 uniformly blue and the grass 4 uniformly green.

Another suitable picture would be of Santa Claus, with extensive red areas.

Figure 2:
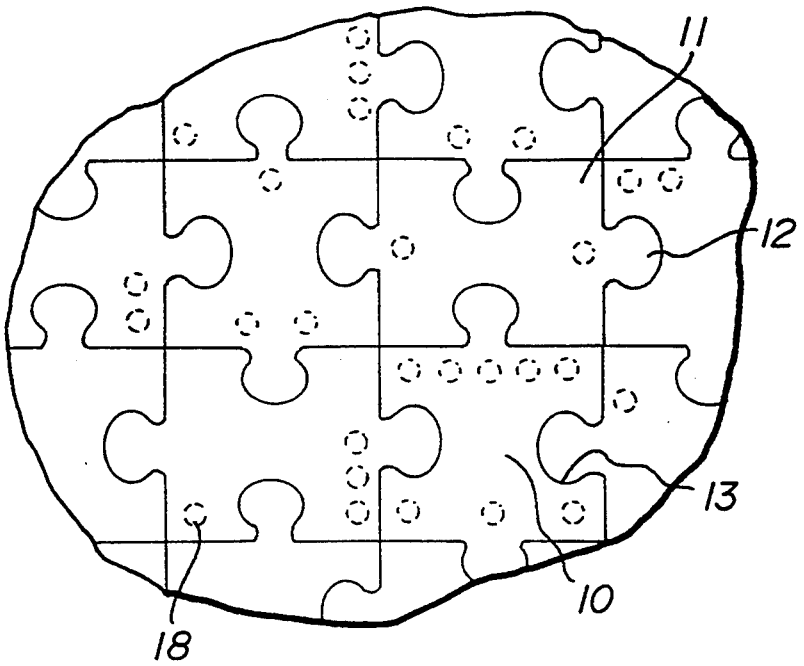
FIG. 2 shows enlarged a part thereof.

Furthermore, apart from those pieces at the edges which in the conventional way have one entirely straight edge, the pieces all have one of two basic shapes. FIG. 2 shows in close up a portion 5 from the pig's back, marked in FIG. 1 by a broken line. FIG. 2 shows how all of the pieces 10, 11 have the same basic nature, namely a rectangular plaque with projecting lobes 12 at two opposite sides and corresponding cutouts 13 at the centres of the other two sides. Because the pieces illustrated are rectangular and not square, they fall into two types; a first type 10 in which the lobes 12 are on the long sides of the rectangle and a second type 11 in which the lobes 12 are on the shorter sides of the rectangle. It will be appreciated that the pieces may be based on a square pattern so that they are all identical.

In the portion 5 illustrated, all of the pieces 10, 11 carry a top printed paper sheet 15 (see FIG. 3) of a uniform pink colour. This applies over the greater part of the pig's body, excepting of course those parts with special picture features such as snout, ears etc. It will easily be understood that these pink pieces, which are of only two types, can be combined in an enormous number of different ways to create an identical visual impression, namely a uniform pink expanse. This uniform pink expanse might consist for example of between 10 and 100 pieces; and the greater the number the greater the number of possible arrangements giving the visually similar result.

Uniform areas of the sky 3 and grass 4 may be similarly constituted respectively from two types only of blue and green pieces. Only those pieces having particular features are more restricted in where they can be placed. While some are unique e.g. the pig's tail, others may have limited freedom e.g. the straight boundary between the sky and grass.

Figure 3:
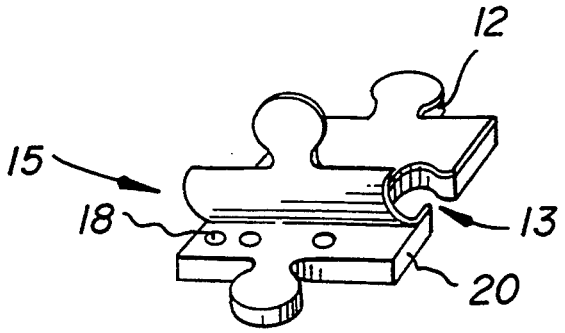
FIG. 3 shows details of construction of a marked piece.

As can be seen from FIGS. 2 and 3, each piece additionally comprises marker spots 18. These are spots of a thin metal layer which are printed onto the backing board 20 of the puzzle before it is covered with the printed picture sheet 15. AS seen in FIG. 3, once the picture sheet 15 is stuck over the marker spots 18, they cannot be seen. For that reason they are shown only dotted in FIG. 2.

The marker spots on each piece are deposited at any combination of 10 locations, 5 of such locations extending along each lobed side of the piece. This gives a very large number of possible patterns of spots.

In an intended use of the puzzle, a large number of people acquiring these puzzles are told additionally that they can enter for a prize, by completing the puzzle and returning it to the manufacturer. The puzzles will all in general be completed to produce the same overall porco-rural effect but the arrangements of metallic spots 18 will all be different. Since the people completing the puzzle cannot see the spots, they will take no account of them. Even if the spots are visible, e.g. are put on the backs of the pieces, it makes no difference.

To judge the entries, a unique standard completion or solution of the puzzle is made, establishing a standard distribution of spots. Alternatively, this could be regarded as a standard distribution of pieces, e.g. if each piece is uniquely identified by its spots.

The submitted completed puzzles are then subjected to scanning e.g. by short wave length electromagnetic radiation, to determine their layout of spots/pieces and compare it with the standard layout. Because of the enormous number of possible layouts, only a minute proportion of entries will correspond to the standard and be adjudged "winner". Or, the entry or entries most closely approximating the standard solution layout will win if none is identical.

Figure 4:
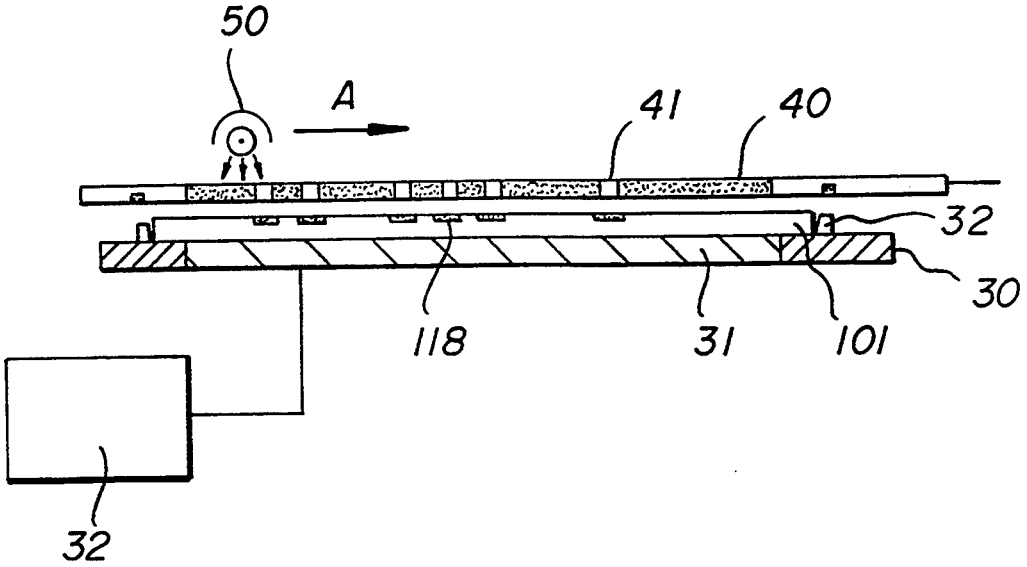
FIG. 4 illustrates a scanning operation.

FIG. 4 illustrates how a radiation scanning and comparison may be carried out. Each completed puzzle 101 is placed on a detector base layer 30 having a radiation-sensitive region 31 at a part where the interchangeable jigsaw pieces may lie. Locators 32 align each completed puzzle in the same way. A solution template 40, which is radiation-opaque except for an array of small windows 41 at positions corresponding to the array of metallic spots 118 in the correctly-solved puzzle, is aligned over the puzzle. A radiation source 50 above the template is activated to direct radiation onto it. Here, the radiation source is a bar which can be scanned across in the direction of arrow A. Insofar as the test puzzle 101 matches the correct solution, no radiation will reach the sensitive layer 31 because a metallic spot 118 of the test puzzle 101 will block radiation passing through the corresponding window hole 41. The figure shows a puzzle solution which is correct at the section, with all the windows covered in this way. Insofar as a piece in the test puzzle does not match the solution, however, radiation from the source 50 will pass through the puzzle substrate board (which is permeable to it) and be detected by the sensitive layer 31, the instances of this being detected and totalled by detection and counting circuitry 32 whose construction and operation are routine matters for a skilled person in the field of photodetection.

If the scanning is done using penetrative radiation it is not even required that submitted completed puzzles be removed from their envelopes or packages. Alignment means can be provided for aligning the puzzle structure array with any detector involved. Entries which do not match the solution can therefore be returned immediately and conveniently to the sender, who can still keep the puzzle for amusement.

Even if a competitor discovers the existence of the metallic spots or other marker, it will avail him/her naught because they will not know the unique solution layout.

It will be understood that the use of metallic spots as markers is only one of a great many possibilities. For example, each piece could be characterised by a metallic strip, following some characteristic curve on the surface of the piece. Other possibilities, and other modes of scanning them conveniently, will occur to the man skilled in the art.

What is claimed is:

1. Puzzle game apparatus comprising a plurality of pieces, the pieces having display portions and means for interfitting with adjacent said pieces to form an assembled puzzle structure, said assembled puzzle structure having a finished visual scheme and said finished visual scheme being a coherent combination of the display portions of the pieces;

at least a plurality of the pieces being changeable pieces, said changeable pieces being capable of taking more than one possible position in a said assembled puzzle structure whereby the apparatus has a plurality of assembled conditions corresponding to said different possible positions of the changeable pieces and each giving an assembled puzzle structure having a said finished visual scheme, and at least a plurality of the changeable pieces comprise respective distinctive markers in addition to their display portions, to indicate distinctively the position of the respective changeable pieces in the assembled puzzle structure and thereby distinguish the assembled conditions from one another in terms of the positions of the markers therein.

2. Puzzle game apparatus as claimed in claim 1, in which the markers are invisible in the finished visual scheme.

3. Puzzle game apparatus as claimed in claim 1 in which the display portions are fragments of a complete picture.

4. Puzzle game apparatus as claimed in claim 1 in which the display portions are fragments of a complete pattern.

5. Puzzle game apparatus as claimed in claim 1 in which the markers are radiation-scannable, and comprise regions of varied opacity of the respective piece to a predetermined type of radiation.

6. Puzzle game apparatus as claimed in claim 5 in which the pieces have board substrates and the markers comprise metallic patches thereon.

7. Puzzle game apparatus as claimed in claim 1 in which the markers are radiation-scannable, and comprise regions of varied reflectivity of the respective piece to a predetermined type of scanning radiation.

8. Puzzle game apparatus as claimed in claim 1 in which the pieces are flat, the assembled puzzle structure is an essentially two-dimensional array and the finished visual scheme is a picture.

9. Puzzle game apparatus as claimed in claim 8 in which the picture has a region of uniform tonal appearance, and the display portions of a plurality of said changeable pieces combine in said region.

10. Puzzle game apparatus as claimed in claim 1 in which there are at least ten changeable pieces.

11. Puzzle game apparatus as claimed in claim 1 in which the changeable pieces are changeable in position by exchanging the location of one changeable piece for that of another within the assembled puzzle structure.

12. Puzzle game apparatus as claimed in claim 1 in which the changeable pieces are changeable in position by changing the orientation of a given changeable piece at a given location within the assembled puzzle structure.

13. A method of operating a puzzle game competition system, comprising providing a plurality of puzzle game apparatus as defined in claim 1;

arranging for the assembly of each puzzle game apparatus to form a plurality of assembled puzzle structures each as defined;

predetermining a target assembled condition for such an assembled puzzle structure;

comparing the respective assembled conditions of the plurality of assembled puzzle game structures with the target assembled condition, by comparison of the positions of the markers therein, and selecting a said assembled puzzle structure whose assembled condition most closely resembles the target assembled condition.

14. A method of operating a puzzle game competition system, comprising providing a plurality of puzzle game apparatus as defined in claim 5;

arranging for the assembly of each puzzle game apparatus to form a plurality of assembled puzzle structures each as defined;

predetermining a target assembled condition for such an assembled puzzle structure;

radiation-scanning the plurality of assembled puzzle structures to determine the arrangement of markers therein, and comparing the determined marker arrangement of each with that of the target assembled condition, and selecting a said assembled puzzle structure whose assembled condition most closely resembles the target assembled condition.

15. A method according to claim 14 in which the arrangement of markers in each assembled puzzle structure is compared with that of the target assembled condition by radiation-scanning a template, said template having an arrangement of markers corresponding to that of the target assembled condition, at the same time as radiation-scanning the assembled puzzle structure.

* * * * *